US011364738B2

(12) United States Patent
Petratou

(10) Patent No.: US 11,364,738 B2
(45) Date of Patent: Jun. 21, 2022

(54) APPLICATOR DEVICE WITH AUTOMATIC RETRACTION

(71) Applicant: SOCIETE BIC, Clichy (FR)

(72) Inventor: Eirini Petratou, Paris (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 17/027,188

(22) Filed: Sep. 21, 2020

(65) Prior Publication Data

US 2021/0094341 A1 Apr. 1, 2021

(30) Foreign Application Priority Data

Sep. 30, 2019 (EP) ..... 19306226

(51) Int. Cl.
*B43M 11/06* (2006.01)

(52) U.S. Cl.
CPC ..... *B43M 11/06* (2013.01)

(58) Field of Classification Search
CPC .... A45D 40/04; B43M 11/06; B65D 83/0011; C09J 9/005
See application file for complete search history.

(56) References Cited

U.S. PATENT DOCUMENTS 5,547,302 A * 8/1996 Dornbusch ..... A45D 40/04 401/172
6,332,729 B1 12/2001 Koreska
6,336,763 B1 * 1/2002 Losier ..... A45D 40/04 401/205
11,033,091 B2 * 6/2021 Wiesenthal ..... A45D 40/065
2016/0297599 A1 10/2016 Heipp

FOREIGN PATENT DOCUMENTS

| | | | |
|---|---|---|---|
| EP | 0612822 | A1 | 8/1994 |
| EP | 2330165 | A1 | 6/2011 |
| WO | 2014001762 | A1 | 1/2014 |

OTHER PUBLICATIONS

Extended European Search Report dated Mar. 27, 2020 in counterpart European Patent Application No. 19306226.2 (8 pages, in English).

* cited by examiner

*Primary Examiner* — David P Angwin
*Assistant Examiner* — Bradley S Oliver
(74) *Attorney, Agent, or Firm* — Bookoff McAndrews, PLLC

(57) ABSTRACT

A glue stick applicator comprising a casing receiving a glue stick, the glue stick being extendable through a mouth of the casing between a retracted position wherein the glue stick is entirely housed in the casing and an extended position wherein the glue stick extends at least in part from the mouth of the casing, and a grid fitted around the glue stick at least when the glue stick is in the extended position, the grid being made of a material having higher gluing capability than the material of the glue stick.

20 Claims, 1 Drawing Sheet

[Fig.1]
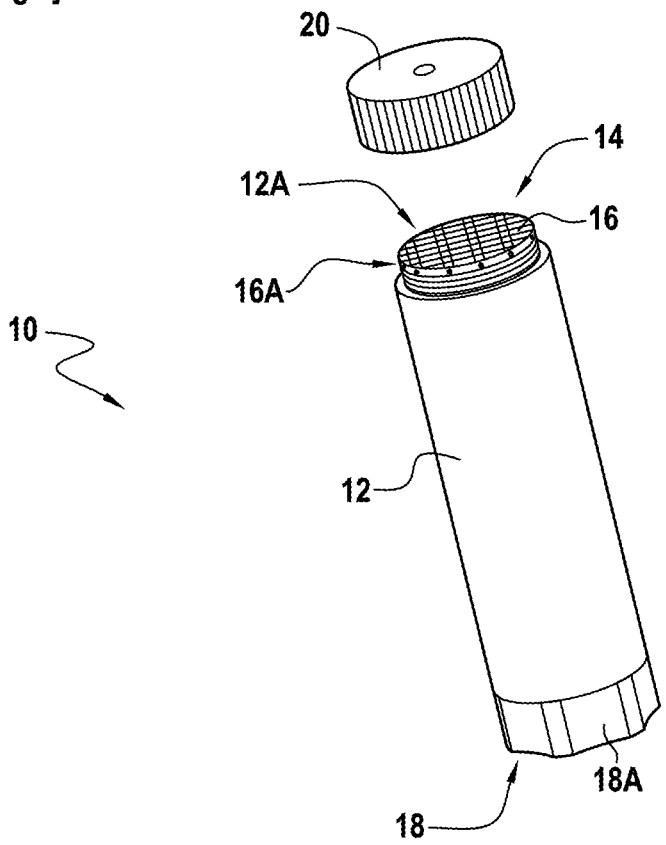
[Fig.2]
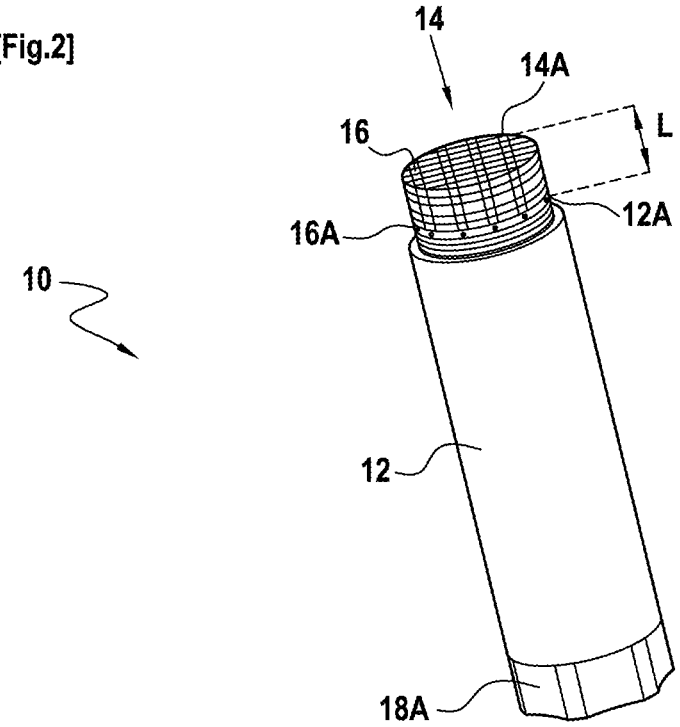

APPLICATOR DEVICE WITH AUTOMATIC RETRACTION

CROSS REFERENCE TO RELATED APPLICATION(S)

This application claims priority to European Application No. EP19306226.2, filed on Sep. 30, 2019, the entire contents of which is incorporated herein by reference.

TECHNICAL FIELD

The present disclosure relates glue stick applicators.

BACKGROUND

Traditional glue sticks of glue stick applicator lose their gluing capability when exposed too long to the atmosphere, for example after several uses or when the cap of the applicator has not been put back. In addition, the glue stick may be broken if it has been extended more than needed. Therefore, a need exists to improve the glue stick applicator performances, in particular with regard to the gluing capability and/or the mechanical reliability of the glue stick.

SUMMARY

An embodiment relates to a glue stick applicator comprising a casing receiving a glue stick, the glue stick being extendable through a mouth of the casing between a retracted position wherein the glue stick is entirely housed in the casing and an extended position wherein the glue stick extends at least in part from the mouth of the casing, and a grid fitted around the glue stick at least when the glue stick is in the extended position, the grid being made of a material having higher gluing capability than the material of the glue stick.

The gluing capability of a material may be assessed by the following method. A sample of the material is tested on 3 different types of paper (for example a printer paper 80 g/m$^2$, a Canson® paper 200 g/m$^2$ (cardboard paper) and a photo paper 250 g/m$^2$) by making for each type of paper, a glue deposit on one side of the paper and add another paper on the glue deposit and then apply pressure with the 1 kg standardised roller (4 forward-return passes, where the glue was deposited). Peeling tests are performed on each glued paper at 23° C. and 50% relative humidity (RH) at 180° (degree of angle) with a speed of 300 mm/min using the Standard method Finat FTM 1. The Standard method Finat FTM 1 comprises: peel adhesion (180°) at 300 millimetres per minute until the tearing of the paper. The relative humidity (RH) is the ratio of the partial pressure of water vapor to the equilibrium vapor pressure of water, these pressures being taken at 23° C. in this case. To do so, the unglue side of the papers is fixed on a metal plate engaged in a top jaw of a tensile apparatus. An extension is added to the leading edge (end of the glued paper), which is engaged in a lower jaw of the tensile apparatus. The evolution of the peeling linear load is drawn as a function of the shift. The failure mode is identified (adhesive, cohesive, tearing of the paper . . . ). Tests specimen dimension are 25 mm×175 mm in machine direction.

The grid having higher gluing capability than the glue stick, and being disposed around the glue stick in the extended position, a mix of glue coming from the glue stick and of glue coming from the grid may be applied by the user when applying glue on a surface. Therefore the global glue capability may be improved, even after several uses and/or after atmosphere exposition. In addition, the grid may form a mechanical reinforcement around the glue stick when extended, which may mechanically strengthen the glue stick and may prevent breakage during use.

In some embodiments, the grid may be configured to limit the extension of the glue stick from the mouth to a predetermined extended position.

This may help to prevent an extension of the glue stick that is more than needed. For example, the predetermined extended position may be defined by the distance between the distal end of the glue stick and the mouth, along the axial direction of the applicator. For example, the predetermined extended position may be comprised between 0.5 cm and 5.0 cm.

In some embodiments, a portion of the grid may be attached to the casing, the grid being configured to elastically deform while the glue stick is extended.

For example, the ratio of the elastic modulus of the glue stick material divided by the elastic modulus of the grid material may be equal or higher than 10.

In some embodiments, the grid may be snap fitted onto the casing.

In some embodiments, the grid may removably attached to the casing.

In some embodiments, the grid may have a disk shape extending in the plane of the mouth when the glue stick is in the retracted position.

In some embodiments, the grid may be made of elastomer.

In some embodiments, the elastomer may comprise at least one among natural rubbers, natural rubber latex, styrene-butadiene block copolymers, polyisoprene, polybutadiene, ethylene propylene rubbers, and ethylene propylene diene rubbers.

In some embodiments, the glue stick applicator may comprise a delivery system configured to move the glue stick between the retracted position and the extended position.

BRIEF DESCRIPTION OF THE DRAWINGS

The disclosure and its advantages can be better understood by reading the detailed description of various embodiments of given as non-limiting examples. The description refers to the accompanying sheets of figures, in which:

FIG. 1 shows a glue stick applicator wherein the glue stick is in the retracted position, and FIG. 2 shows the glue stick applicator of FIG. 1 wherein the glue stick is in the extended position.

DETAILED DESCRIPTION

Throughout the present description and claims a grid is to be understood as a grating or a framework of parallel bars. Also within the context of the present description and claims a grid is to be understood as a network of spaced apart horizontal and vertical bars or lines.

A glue stick applicator 10 is described with reference to FIGS. 1 and 2. The glue stick applicator 10 comprises a housing 12 receiving a glue stick 14 and a grid 16. The glue stick 14 is extendable through a mouth 12A of the casing 12 between a retracted position, shown in FIG. 1, wherein the glue stick 14 is entirely housed in the casing 12, and an extended position, shown on FIG. 2, wherein the glue stick 14 extends at least in part from the mouth 12A of the casing 12.

The glue stick applicator 10 may be provided with a delivery system 18 configured to move the glue stick 14 between the retracted position and the extended position. The delivery system 18 may comprises a rotatable knob 18A, the rotation of which by the user driving the glue stick 14 between retracted position and the extended position, in a manner known by the skilled person.

The glue stick applicator 10 may comprise a removable protection cap 20, which may be screwable onto the casing 10. The cap 20 may protect and isolate, at least in part, the glue stick 14 from the atmosphere.

In the extended position, as shown in FIG. 2, the grid 16 may be fitted around the glue stick 14. For example, only the portion of the glue stick 14 which is extended from the mouth 12A may be fitted with the grid 16. In the retracted position, as shown in FIG. 1, the grid 16 may have a disk shape and may extend in the plane of the mouth 12A. The grid 16 may cover the distal end 14A of the glue stick 14 in any position.

A portion 16A of the grid 16 may be attached to the casing 12. The portion 16A may be removably snap fitted onto the casing 12, for example in a manner known by the skilled person.

As shown in FIG. 2, the grid 16 may be configured to elastically deform while the glue stick 14 is extended. The grid 16 may have a maximum elastic deformation which is configured to limit the extension of the glue stick 14 from the mouth 12A to a predetermined extended position. For example, the maximum extended position is a position wherein the length L between the distal end 14A of the glue stick 14 and the mouth 12A is 2.0 cm.

The grid 16 is made of a material having higher gluing capability than the material of the glue stick 14. The grid 16 may be made of elastomer. For example, the grid may be made of natural rubbers, natural rubber latex, styrene-butadiene block copolymers, polyisoprene, polybutadiene, ethylene propylene rubbers, or ethylene propylene diene rubbers.

Although the present invention is described with reference to specific examples, it is clear that modifications and changes may be made to these examples without going beyond the general scope of the invention as defined by the claims. In particular, individual characteristics of the various embodiments shown and/or mentioned may be combined in additional embodiments. Consequently, the description and the drawings should be considered in a sense that is illustrative rather than restrictive.

Additionally, all of the disclosed features of an apparatus may be transposed, alone or in combination, to a method and vice versa.

The invention claimed is:

1. A glue stick applicator comprising a casing that receives a glue stick, the glue stick being extendable through a mouth of the casing between a retracted position wherein the glue stick is entirely housed in the casing and an extended position wherein the glue stick extends at least in part away from the mouth of the casing, and a grid fitted around the glue stick at least when the glue stick is in the extended position, the grid formed of a material that has higher gluing capability than the material of the glue stick.

2. The glue stick applicator according to claim 1, wherein the grid is configured to limit the extension of the glue stick from the mouth to a predetermined extended position.

3. The glue stick applicator according to claim 2, wherein the grid is made of a material having a maximum elastic deformation so as to limit the extension of the glue stick from the mouth to the predetermined extended position.

4. The glue stick applicator according to claim 2, wherein the predetermined extended position is between 0.5 cm and 5.0 cm.

5. The glue stick applicator according to claim 2, wherein the maximum predetermined extended position is a position wherein the length between a distal end of the glue stick and the mouth of the casing is 2.0 cm.

6. The glue stick applicator according to claim 1, wherein a portion of the grid is attached to the casing, the grid being configured to elastically deform while the glue stick is extended.

7. The glue stick applicator according to claim 1, wherein the grid is snap fitted onto the casing.

8. The glue stick applicator according to claim 1, wherein the grid is removably attached to the casing.

9. The glue stick applicator according to claim 1, wherein the grid has a disk shape extending in the plane of the mouth when the glue stick is in the retracted position.

10. The glue stick applicator according to claim 1, wherein the grid is made of elastomer.

11. The glue stick applicator according to claim 10, wherein the elastomer comprises at least one among natural rubbers, natural rubber latex, styrene-butadiene block copolymers, polyisoprene, polybutadiene, ethylene propylene rubbers, and ethylene propylene diene rubbers.

12. The glue stick applicator according to claim 1, comprising a delivery system configured to move the glue stick between the retracted position and the extended position.

13. The glue stick applicator according to claim 12, wherein the delivery system includes a rotatable knob, the rotation of which drives the glue stick between the retracted position and the extended position.

14. The glue stick applicator according to claim 13, wherein the grid has a disk shape extending in the plane of the mouth when the glue stick is in the retracted position.

15. The glue stick applicator according to claim 14, wherein the grid is formed of a material that has higher gluing capability than the material of the glue stick based on a Standard method Finat FTM 1 test.

16. The glue stick applicator according to claim 1, wherein the grid is formed from a set or network of spaced apart horizontal and vertical bars.

17. The glue stick applicator according to claim 1, wherein the grid is formed of a material that has higher gluing capability than the material of the glue stick based on a Standard method Finat FTM 1 test.

18. The glue stick applicator according to claim 1, wherein the elastic modulus of the glue stick material divided by the elastic modulus of the grid material may be equal or higher than 10.

19. A glue stick applicator comprising a casing that receives a glue stick, the glue stick being extendable through a mouth of the casing between a retracted position where the glue stick is entirely housed in the casing and an extended position where the glue stick extends at least in part away from the mouth of the casing, a delivery system configured to move the glue stick between the retracted position and the extended position, and a grid fitted around the glue stick at least when the glue stick is in the extended position, the grid formed of a material that has higher gluing capability than the material of the glue stick based on a Standard method Finat FTM 1 test, wherein the grid is made of a material having a maximum elastic deformation so as to limit the extension of the glue stick from the mouth to the predetermined extended position between 0.5 cm and 5.0 cm;

the grid is removably attached to the casing;

the grid has a disk shape extending in the plane of the mouth when the glue stick is in the retracted position;

the grid is made of elastomer comprising at least one among natural rubbers, natural rubber latex, styrene-butadiene block copolymers, polyisoprene, polybutadiene, ethylene propylene rubbers, or ethylene propylene diene rubbers;

the grid is formed from a set or network of spaced apart horizontal and vertical bars; and the elastic modulus of the glue stick material divided by the elastic modulus of the grid material may be equal or higher than 10.

20. A glue stick applicator comprising a casing that receives a glue stick, the glue stick being extendable through a mouth of the casing between a retracted position where the glue stick is entirely housed in the casing and an extended position where the glue stick extends at least in part away from the mouth of the casing, and a grid fitted around the glue stick at least when the glue stick is in the extended position, the grid formed of a material that has higher gluing capability than the material of the glue stick based on a Standard method Finat FTM 1 test.

* * * * *